United States Patent [19]

Beer et al.

[11] 4,124,967

[45] Nov. 14, 1978

[54] METHOD AND APPARATUS FOR PLACING FLEXIBLE PACKAGES IN CONTAINERS

[76] Inventors: Frederick W. Beer, 270 Timberbank Blvd., Unit 55, Agincourt, Ontario M1W 2M1; Fedor P. Kresak, 31-12 Sentinel Rd., Downsview, Ontario; Conio Kuev, 620 Lolita Gardens, Apt. 1909, Mississauga, Ontario, all of Canada

[21] Appl. No.: 834,559

[22] Filed: Sep. 19, 1977

[51] Int. Cl.[2] ..... B65B 35/ 54; B65B 57/08; B65B 57/16

[52] U.S. Cl. ..... 53/446; 53/473; 53/55; 53/499; 53/505; 53/544; 53/250

[58] Field of Search ..... 53/26, 35, 55, 62, 63, 53/159, 247, 250

[56] References Cited

U.S. PATENT DOCUMENTS

| | | | |
|---|---|---|---|
| 4,045,941 | 9/1977 | Flantua | 53/35 |
| 4,052,837 | 10/1977 | Saintonge | 53/62 |

*Primary Examiner*—Travis S. McGehee

*Attorney, Agent, or Firm*—Stevens, Davis, Miller & Mosher

[57] ABSTRACT

Apparatus for placing flexible packages in a rigid container incorporates an infeed chute and diverter gate system for directing packages into a rotatable load head in preselected fashion. After the load head is filled, the packages are released therefrom into an empty shipping container located below the load head. The apparatus incorporates a control system which activates the components of the system in preselected cyclic fashion to enable continuous packaging in a rapid manner. The apparatus is especially suitable for the handling of flexible packages of fluid products such as milk. A method of effecting continuous packaging is also described.

33 Claims, 14 Drawing Figures

METHOD AND APPARATUS FOR PLACING FLEXIBLE PACKAGES IN CONTAINERS

The present invention relates to apparatus and method for placing flexible packages in rigid containers in a predetermined pattern. The invention is particularly suitable for use in connection with flexible packages containing liquids such as milk although it will be realized that the invention is adaptable for use with a wide variety of products.

With particular reference to the dairy industry, the packaging of milk in flexible pouches, and the bagging of three of these pouches into an outer bag has gained widespread acceptance in the dairy industry. Although there are automatic baggers in use for placing the individual pouches of milk in an outer bag, these bags are still being manually loaded into cases. As a result, an excessive amount of labour dollars are required to package and ship milk products in this manner.

It is a basic object of the present invention to provide method and apparatus for rapidly and efficiently positioning flexible packages in a rigid shipping container with such packages being positioned in the container in a preselected array or pattern.

As a result of the gradual adoption in both Canada and the United States of metric standards, there is a further requirement that the apparatus be capable of handling at least a reasonable combination of package sizes and rigid container sizes. By way of example, the apparatus may be called upon to handle either imperial three quart packages or metric four litre packages and to load these packages into present Canadian standard size dairy cases or metric or U.S. size dairy cases.

It is also advantageous to provide equipment which avoids the need for dividers within the rigid container for separating the flexible packages from one another. Case dividers occupy additional space, and represent an additional cost which should be avoided if at all possible.

Thus, a further object of the present invention to provide apparatus and method for packaging flexible packages which permits a certain degree of variation in size of the flexible packages and the rigid containers in which they are packaged and which also eliminates the need for dividers within the rigid shipping container.

Apparatus according to one aspect of the invention includes means defining a plurality of chutes, each chute having an infeed end and a discharge end, with the chutes being adapted for travel of packages therethrough from the infeed end to the discharge end. A diverter gate is located at the infeed end of the chutes for selectively directing packages moving toward the infeed ends of the chutes into the infeed ends of the respective chutes. A loading head is associated with the discharge ends of the chutes, the loading head having a plurality of pockets therein each adapted to hold a package received therein from the discharge ends of the chutes. The loading head is rotatably mounted to enable selected pockets thereof to be positioned to receive a package from a respective one of the discharge ends of the chutes. Discharge gates are respectively associated with the pockets of the loading head for releasing packages therein and dropping them into a rigid container which, during operation, has been moved into a position below the loading head. The apparatus includes a control and actuator means for actuating the diverter gate, rotating the loading head and actuating the discharge gates in predetermined cyclic fashion to enable continuous packaging of the packages in successive rigid containers which have been individually positioned below the loading head.

In accordance with a further aspect of the invention the discharge gates are each located at the bottom of their associated pockets. The pockets are arranged to receive and to hold the packages in closely spaced upright orientation. The control and actuator means are adapted to open the gates simultaneously with the gates and pockets being arranged to induce the released packages to maintain their upright orientation as they fall into the container.

In accordance with a further feature of the invention, said control and actuator system is adapted to respond to the passage of packages toward the infeed ends of the said chutes and to (a) move the diverter gate so as to direct individual incoming packages alternately down the first and second chutes, (b) to rotate the loading head from the first position to the second position after a package is located in each of the pockets of the first pair, and (c) actuate the discharge gates after a package has been positioned in each of the pockets of the first and second pairs to release the packages from the loading head.

In accordance with a still further feature of the invention there is provided stop means for positively locating the rigid container at a loading station defined beneath the loading head while packages are being released thereinto, the control and actuator means further being adapted to actuate the stop means to allow a filled container to be moved away from the loading station and an empty container to take its place while the pockets of the loading head are receiving packages from the discharge ends of the chutes.

In a still further feature of the invention, the control and actuator means includes means for sensing the presence of a container at the loading station for receiving packages from the loading head, and means for stopping the feed of packages to the infeed ends of the chutes in the absence of a container at the loading station.

The apparatus is adapted to be used in conjunction with a conveyor line defining a path of travel for the rigid containers with the loading head being located over the path of travel so that the conveyor line is capable of supplying empty containers to the loading station and moving filled containers away therefrom.

In a preferred form of the invention, the above-noted chutes comprise first and second chutes. The loading head has first and second pairs of pockets therein which are arranged such that when the loading head is in a first position, the pockets of the first pair are each aligned with a respective one of the discharge ends of the first and second chutes, and when the loading head is in a second position, the pockets of the second pair are each aligned with a respective one of the discharge ends.

According to a further feature of the invention, the first chute is arranged such that a package travelling therealong takes a longer time to travel from the infeed end to the discharge end than does a package travelling along the second chute. This arrangement allows for sufficient time to release the packages from the loading head while a further package is travelling along the first chute.

In a preferred embodiment, the first and second positions of the loading head are 90° apart. The loading head is mounted for rotation about a vertical axis with the pockets therein being arranged in side-by-side generally vertical orientation about the rotation axis. The pockets of the loading head are generally rectangular in plan with the pockets of each pair being spaced apart in the direction of their width dimensions and being overlapped with one another in the direction of their length dimension. In accordance with a further feature, the discharge ends of the chutes overlap with one another to correspond with the overlap of the pockets of the load head. In accordance with a still further feature the chutes are adapted for movement of the packages therethrough toward the discharge ends of the chutes under the influence of gravity. The bottoms of the chutes are preferably provided with free running rollers or the like to permit the free movement of the packages therethrough.

In a preferred form of the invention the above-noted control and actuator system includes means for sensing the passage of packages toward the infeed ends of the chutes with the system being adapted to respond to the passage of the individual packages to effect the actuation of the various components of the apparatus in the above-noted predetermined cyclic fashion. The sensing means may conveniently include a photoelectric cell arrangement.

In the preferred embodiment of the invention, the diverter gate is pivotally mounted and arranged such that it is capable of separating the flexible packages and directing them alternately into the first and second chutes in such a way as to virtually eliminate package jamming due to improper spacing of the incoming packages on an infeed conveyor which supplies the chute means.

The above-described system is capable of providing a symmetrical loading pattern which is believed to be unique for the package-rigid container or dairy case combination which those in the dairy industry are required to work with. The rotating load head feature combined with the infeed end diverter arrangement eliminates the need for a second set of trap doors for accumulation of packages as called for by certain prior art designs (see Canadian Pat. No. 886,413). Furthermore, because the first bag of every loading cycle always travels down that chute providing the longest travel time, sufficient time is provided to unload the loading head while the first bag of the next cycle is travelling down such chute. Furthermore, because of the symmetrical loading pattern, the load head need be rotated 90° once during each load cycle hence eliminating unnecessary movements of the machine and minimizing machine wear. Also by virtue of the loading pattern provided by a preferred embodiment of the invention and the symmetrical discharge gate arrangement provided, the need for raising the shipping case or lowering the loading head as in certain prior art designs (see Canadian Pat. No. 730,001) is eliminated. The system according to the invention is also capable of maintaining the package shape until the packages are deposited into the rigid containers. Since the packages are dropped simultaneously into the rigid containers, a "shoe horn" effect is achieved i.e. the packages fit quite tightly into the rigid containers.

Certain prior art systems also tend to drop the packages on their sides. If this were tried in the case of flexible packages of liquid, there would be danger of rupturing the package due to the hydraulic shock from the liquid and/or the package may be distorted in shape thus detracting from its appearance. Since the system of the present invention drops the packages endwise, the danger of rupture occuring from hydraulic shock is minimized and distortion of the package is reduced thus providing a neat finished package appearance.

In accordance with a further aspect of the invention there is provided a method of packing flexible packages in a rigid container. The method includes the steps of feeding the packages along a conveyor line in single file, and separating the packages and directing single packages alternately into respective ones of a plurality of chutes. Each of the packages are allowed to travel individually along the chutes and each package is caused to pass into a respective one of a plurality of vertically disposed pockets of a rotatable load head. After the last one of a first group of the packages has been located in a respective pocket of the load head, the load head is rotated to position a further plurality of pockets thereof in locations such that each can accept a respective one of the packages of a second group from the chutes. After the last one of the second group of packages is in a respective one of the further plurality of pockers, all the packages are released simultaneously from the pockets of the load heads such that they fall by gravity into a rigid container positioned below the load head. The pockets of the loading head are arranged to hold the packages in preselected upright orientation relative to one another, and the release of the packages is effected such that the preselected orientation of the package is substantially retained as they drop into the rigid container. The container is shaped and dimensioned to snugly receive the packages and to maintain the orientation thereof. The filled container is then moved away from beneath the load head and an empty container is moved into position below the load head. The above recited steps continue to be carried out thereby to effect packaging of groups of the packages in successive rigid containers.

In accordance with a further feature of the invention the packages are released as a first package of a further group is travelling along one of the chutes toward the load head with the time of travel along said one of the chutes occupying a sufficient interval of time as to permit the releasing step to be completed before the first package of the further group enters the load head.

In accordance with a still further feature of the invention the filled container is moved away from beneath the load head and an empty container is moved into loading position while the pockets of the load head are being filled with a further group of flexible packages.

In accordance with a further feature of the invention the packages are held by the pockets of the loading head in a closely juxtaposed generally rectangular-in-outline array to enable them to fit snugly into a rigid container of corresponding rectangular outline shape.

An embodiment of the invention will now be described by way of example with reference to the accompanying drawings wherein.

Figure 1:
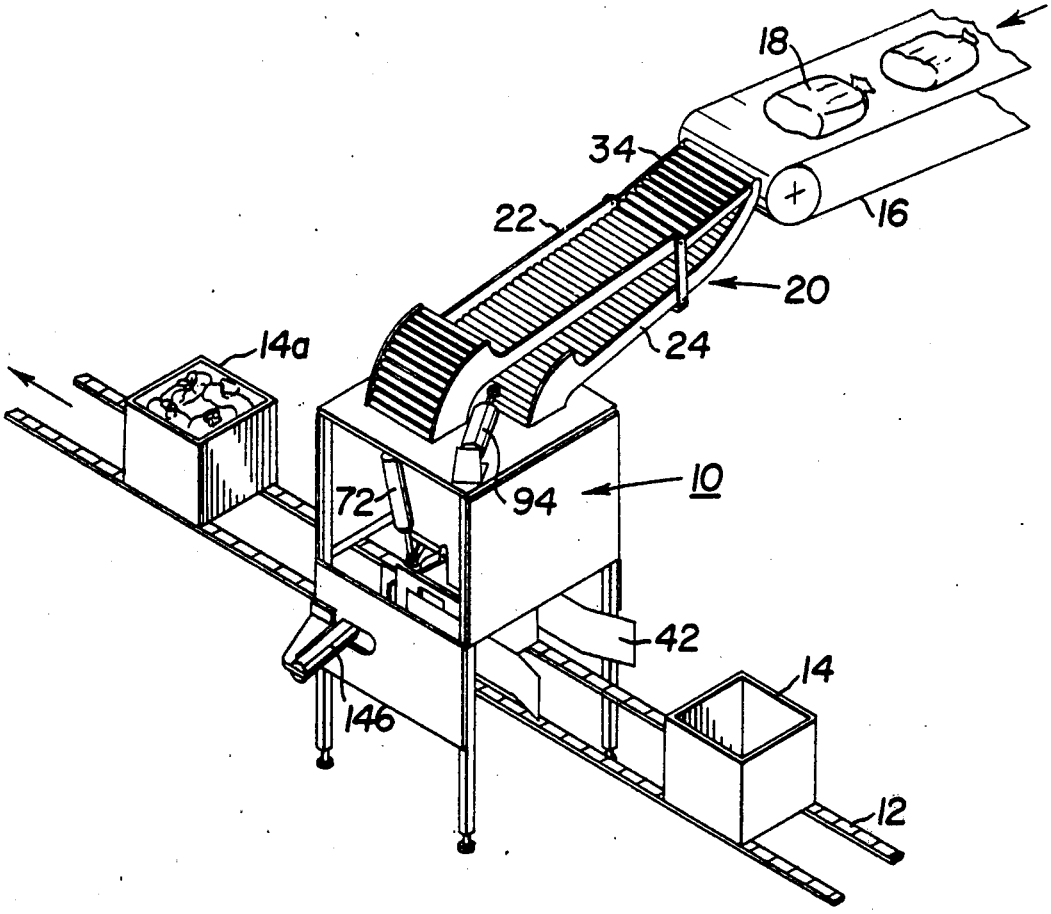
FIG. 1 is a perspective view of the apparatus in accordance with the invention (load chutes being located at right angles to the conveyor line for shipping containers)

With reference to FIG. 1 of the drawings there is shown an apparatus 10 according to the invention positioned above a continuously moving conveyor line 12 which serves to convey empty containers 14 to a loading station beneath apparatus 10 and to convey filled containers 14*a* away from such loading station. An infeed conveyor system 16 serves to convey packages of milk 18 toward the infeed ends of a chute arrangement 20.

The packages of milk shown are of the type consisting of three individual milk filled pouches positioned within a plastic overbag with the overbag being closed by means of a plastic tie or "Kwik-lok" (registered trademark). The packages are fed toward apparatus 10 by the infeed conveyor bottom end first in single file with the packages usually being fairly closely spaced together. The infeed conveyor 16 does not, per se, form a part of the invention nor does the apparatus for positioning the flexible packages 18 thereon. The packages may be placed on infeed conveyor 16 manually but, more commonly, the packages are positioned on such conveyor by an orientation unit located at the discharge end of the apparatus for applying the plastic ties to the overbag.

It should also be noted here that the chute arrangement 20 may be oriented either at right angles to the case conveyor 12 as illustrated in FIG. 1 or it may be arranged in parallelism therewith as illustrated in FIGS. 2–7. This is merely a matter of convenience depending upon the layout desired in any particular dairy. In addition, it is noted that the conveyor line 12 may conveniently form a part of a previously existing installation with the apparatus 10 simply being positioned thereover in a suitable location and connected thereto in any desired fashion.

Figure 2:
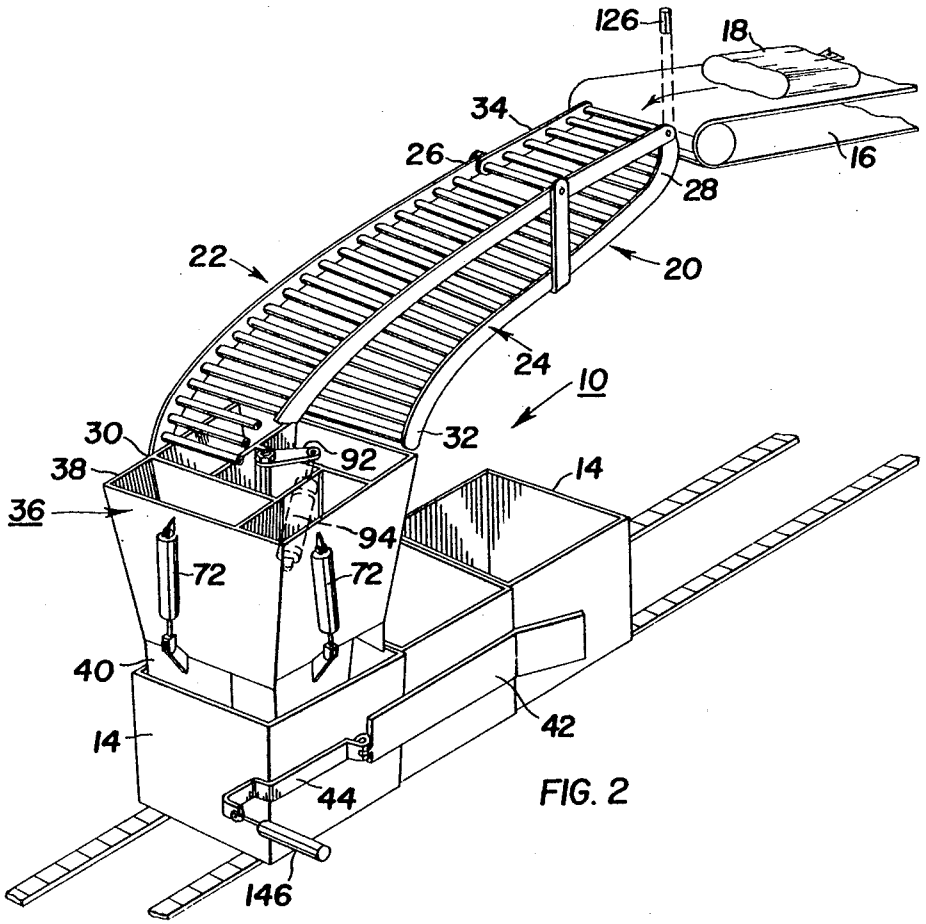
FIG. 2 is a perspective view of the apparatus in somewhat diagrammatic form illustrating certain of the basic components of the apparatus (the feed chute arrangement being in line with the conveyor for shipping containers)

With reference to FIG. 2 which illustrates the apparatus in somewhat diagrammatic form with certain nonessential items removed to show the interior structure, it will be seen that the chute arrangement 20 comprises first and second chutes 22 and 24 respectively, having infeed ends 26 and 28 respectively and discharge ends 30 and 32 respectively. A diverter gate 34 is located in the vicinity of the infeed ends of the first and second chutes for selectively diverting or directing the packages 18 moving toward the infeed ends of the chutes along infeed conveyor 16 into the infeed ends of the respective chutes 22 and 24. A loading head 36 is positioned just below the discharge ends of the chutes with such loading head having a plurality of pockets 38 defined therein each adapted to hold a package received therein from the discharge ends of the two chutes. This loading head 36 is rotatably mounted about a vertical axis to enable selected pockets 38 thereof to be each positioned to receive a package from a respective one of the discharge ends of the first and second chutes 22 and 24. Discharge gates 40 are respectively associated with the pockets 38 of the loading heads 36 for releasing packages therein and dropping them into a rigid container 14 which, during operation, has been moved into a loading station defined directly below the loading head 36. The system also includes a control and actuator means, to be further described hereinafter, for actuating the discharge gates 40, rotating the loading head 36, and actuating the diverter gate 34 in predetermined cyclic fashion to enable the packaging of the packages in successive rigid containers or shipping crates 14 which have been individually positioned below the loading head 36. The apparatus further includes guide means 42 for guiding and aligning the shipping containers 14 as they are moved along by conveyor 12 toward the loading station. Also provided at the loading station is a stop hook 44 for positively locating each rigid container 14 at the loading station defined beneath the loading head while packages are being released thereinto. The above-noted control and actuator system is adapted to actuate the stop hook to allow a filled container to be moved away from the loading station by the conveyor 12 and an empty container to take its place while the pockets of the loading head 36 are receiving packages from the discharge ends of the first and second chutes 22 and 24.

Reference will now be had to FIGS. 3–8 which illustrate the apparatus in further detail. It will be seen that the apparatus includes a support frame 50 including spaced apart upright support legs 52 having suitable side panel members 54 bolted thereto thereby to partially enclose the rotatable loading head 36. The support frame includes a sturdy, horizontally disposed top support plate 56 which plate 56 serves to mount both the chute arrangement 20 as well as the rotatable load head 36.

Figures 3, 4:
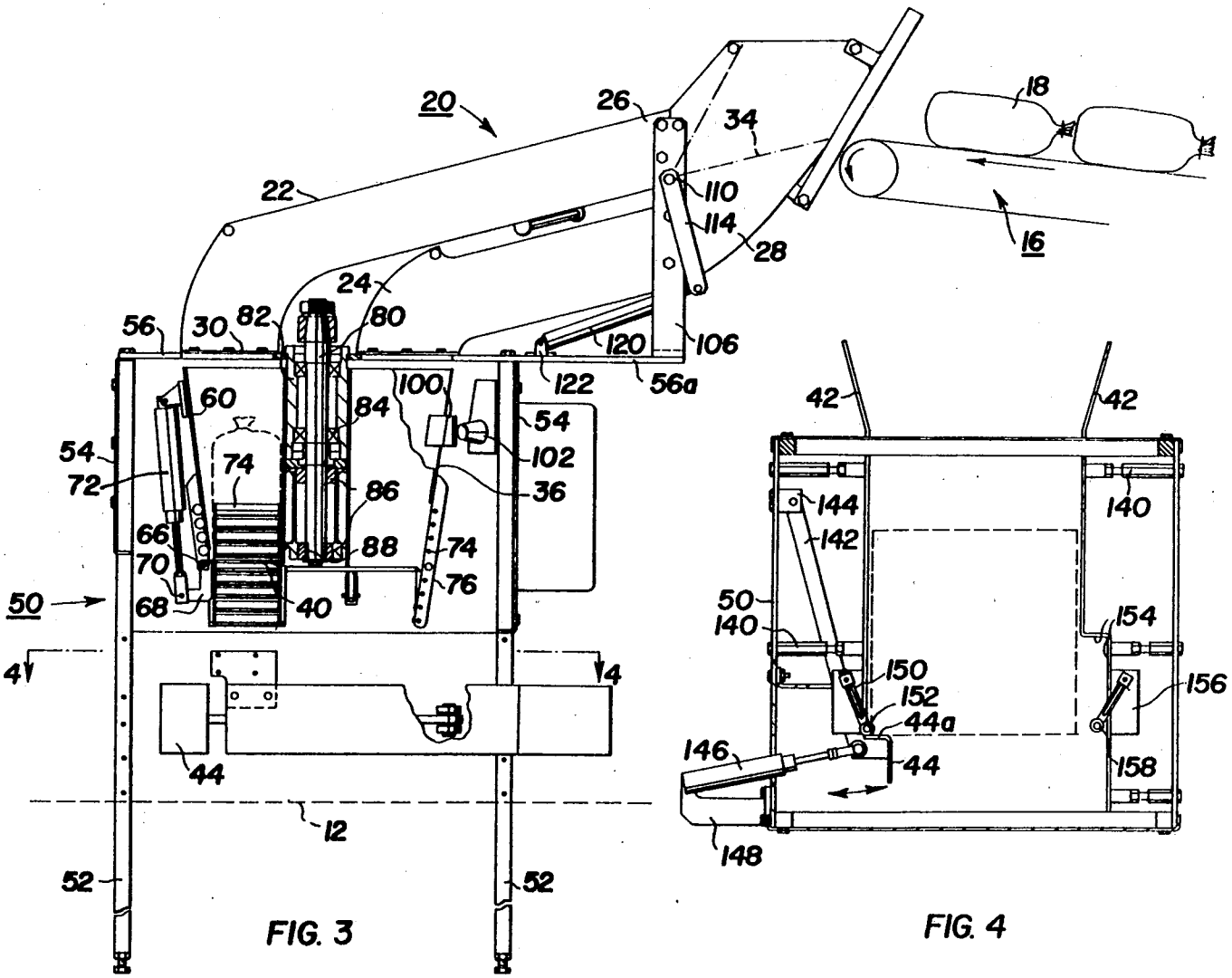
FIG. 3 is a side elevation view, partially in section, of apparatus according to the invention.
FIG. 4 is a section view taken along line 4—4 of FIG. 3 and looking in the direction of the arrows.
Figure 8:
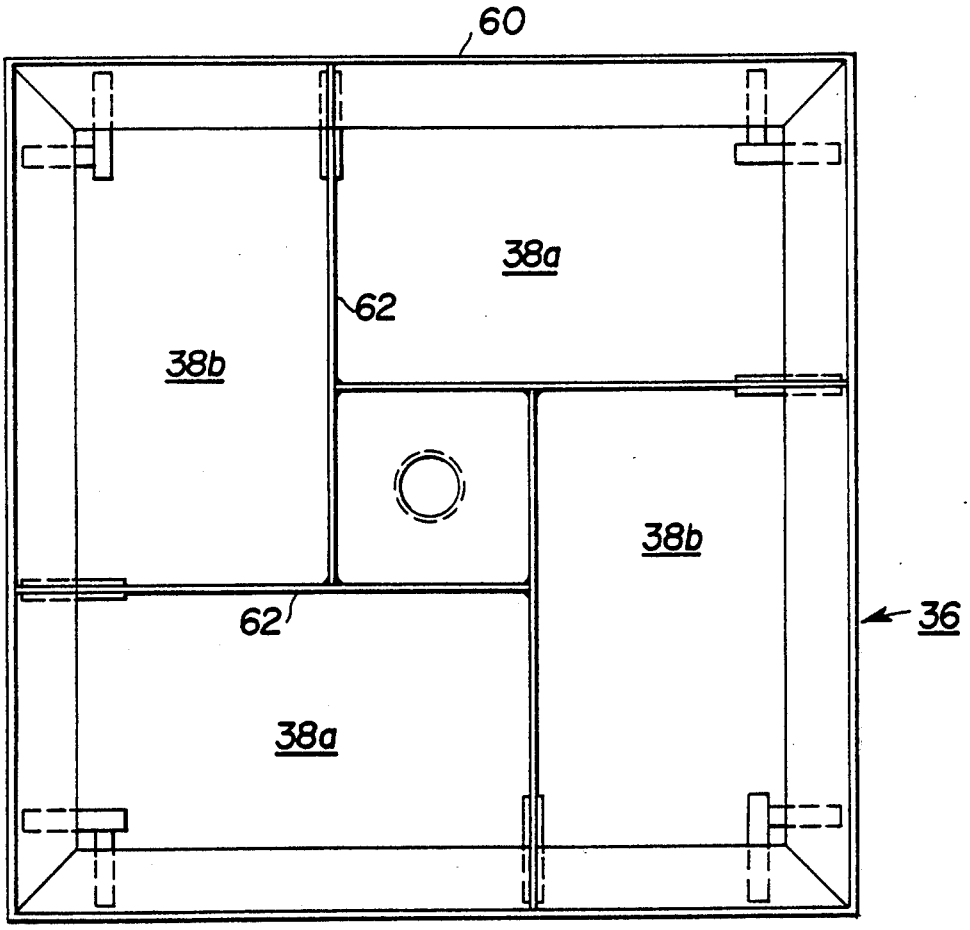
FIG. 8 is a plan view of the loading head.

The load head 36, as best seen in FIGS. 3 and 8, is of a generally square outline in plan with the four side walls 60 thereof being sloped inwardly at a relatively shallow angle. The loading head includes internal partition members 62 which serve to subdivide the interior of the loading head into four side-by-side generally upright pockets 38, with each of the pockets having a rectangular outline in plan. It will be seen that the pockets 38 actually comprise two pairs of pockets 38*a* and 38*b* respectively. It will be seen that the pockets of the first pair e.g. 38*a* are spaced apart in the direction of their width dimensions and that they actually overlap with one another in the direction of their length dimension. The same holds true for the second pair of pockets i.e. pockets 38*b*. By virtue of this arrangement, packages positioned in the pockets are held in a closely juxtaposed generally rectangular-in-outline array.

Figure 8A:
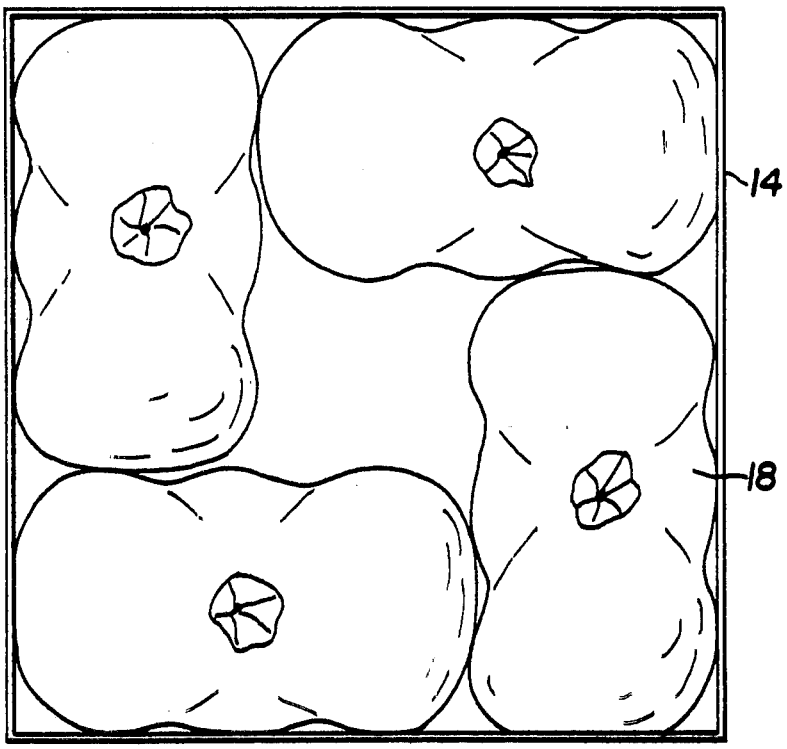
FIG. 8A is a plan view of a shipping container with the packages therein being in a preselected array or pattern.

The bottom of each of the pockets 38*a*, 38*b* is defined by a respectively associated discharge gate 40. The discharge gates are pivotally mounted about respectively associated hinge elements 66 defining pivot axes lying parallel to their associated lower horizontal edges of the loading head 36. Each gate 40 has an arm 68 rigidly connected thereto, the outer end of each such arm being connected at 70 to the ram of a pneumatic cylinder 72. Thus when the rams of the several pneumatic cylinders 72 are retracted, their associated discharge gates 40 are caused to swing downwardly into vertically disposed "open" positions while extension of such rams causes the gates to swing in the opposite direction into horizontally disposed "closed" positions. In order to assist in the free movement of the packages out of the respective pockets 38 of the load head 36, the lower portions of the inwardly sloping side walls 60 are provided with horizontally disposed roller elements 74, such roller elements being mounted to support members 76 which extend downwardly a short distance below the discharge gates 40 in their horizontal positions thereby to assist in the free movement of the packages out of the respective pockets 38 when the gates 40 are opened and to further assist in directing the packages accurately into the shipping containers 14 to provide the preselected array or pattern shown in FIG. 8A.

The loading head 36 is mounted for rotation about a vertical axis defined by a vertically oriented main shaft 80. Main shaft 80 is disposed within a vertically disposed tubular shaft housing 82, the upper end of which is rigidly affixed to top plate 56. Main shaft 80 has suitably arranged shoulders thereon which interact with oppositely disposed thrust bearings 84 seated in the shaft housing 82. The lower end of main shaft 80 projects downwardly below the lower end of shaft housing 82 and extends through a pair of vertically spaced mounting blocks 86, the latter being welded to inwardly directed surfaces of above mentioned partitions 62. The lower end of main shaft 80 is firmly keyed at point 88 to the lower support block 86 so that the entire load head 36 rotates together with the main shaft 80. The uppermost end portion of main shaft 80 projects above top plate 56 and a relatively short sturdy lever arm 90 is connected thereto. Lever arm 90 is pivotally connected at its outer end at point 92 to the ram of a load head rotate cylinder 94. Cylinder 94 is of the pneumatically actuated variety and is pivotally connected at point 96 to a mounting bracket 98 affixed to top plate 56. As the ram of cylinder 94 is extended and retracted the entire load head 36 is rotated about the vertically disposed rotation axis defined by main shaft 80 back and forth between first and second positions which are 90° apart. In order to establish these first and second positions, the load head has an outwardly extending lug 100 secured thereto which makes contact at both of the first and second positions with rubber stop members 102 secured to the main frame 50 by suitable bracket means as illustrated in FIG. 3.

It was noted previously that the chute and diverter assembly 20 included first and second chutes 22 and 24. It will be noted that the discharge ends 30 and 32 of these two chutes are bolted to top plate 56 while the inlet end portions 26 and 28 thereof are supported by a support bracket 106 connected to and extending upwardly from an extended portion **56*a* of top plate 56. It will be seen that the first chute 22 is actually disposed above the second chute 24 (see FIG. 3) and that the first chute 22 is somewhat greater in length than the second chute 24. It will also be noted that the discharge ends 30 and 32 of the two chutes are not disposed in vertical alignment but, rather, are offset from one another thereby to correspond with the previously described arrangement of the respective pairs of pockets 38*a* and 38*b* of the loading head 36. That is, when the loading head 36 is in a first position, the pockets 38*a* of the first pair are each vertically aligned with a respective one of the discharge ends 30, 32 of the first and second chutes and, when the loading head is in its second position at 90° to the first position, the pockets 38*b* of the second pair are each aligned with a respective one of the discharge ends 30, 32 of the first and second chutes. This offset arrangement of the discharge ends 30, 32**, is best illustrated in the plan view of FIG. 6.

Figure 6:
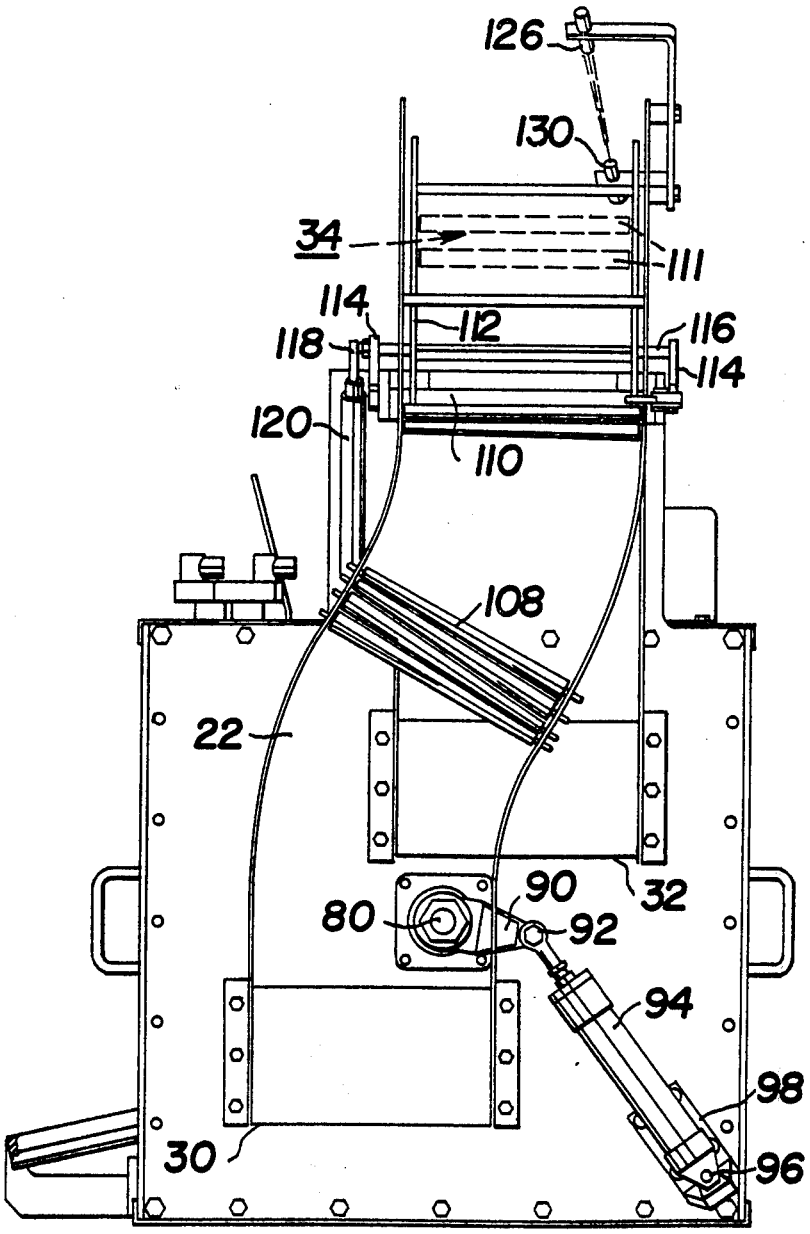
FIG. 6 is a plan view of the apparatus.

In contrast to the discharge end of the chutes, the inlet ends 26, 28, of the two chutes are disposed directly above one another in vertically spaced relationship. The upper chute 22 is smoothly contoured in plan as best seen in FIG. 6 thereby to accommodate the above-described offset. In order to enable the flexible packages to travel freely down the respective chutes 22 and 24, the floor portions of each chute comprise a series of closely spaced freely rotatable rollers 108. These freely rotatable rollers permit the flexible packages to be placed on the respective chutes to travel freely under the influence of gravity from the inlet ends thereof to the discharge ends and thence into the respective pockets of the loading head 36. It was noted above that the upper chute 22 is somewhat longer than chute 24. Thus, a package travelling along chute 22 requires a somewhat longer period of time to travel from its inlet end to its discharge end than does a package travelling along chute 24. This time differential is of some significance as will be seen hereinafter.

Figure 7:
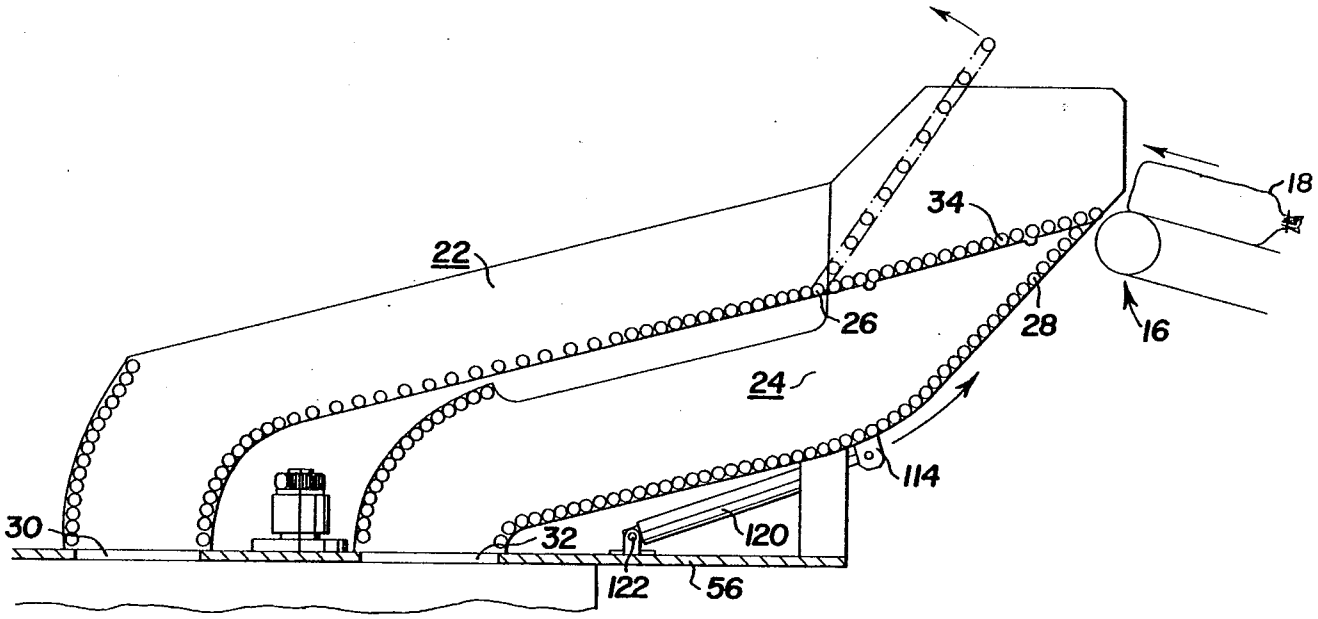
FIG. 7 is a somewhat diagrammatic elevation view taken in section of the infeed chute arrangement.

Reference was made previously to the diverter gate 34 which acts to direct individual incoming packages from infeed conveyor 16 alternately down the first and second chutes 22 and 24. With particular reference to FIGS. 6 and 7 it will be seen that the diverter gate 34 is pivotally mounted via a horizontally disposed transversely extending rod 110, the opposite ends of which are rotatably mounted in the upright support brackets 106. The diverter gate 34 includes spaced apart parallel arms 112 rigidly affixed to transverse rod 110 with a series of closely spaced rollers 111 extending between arms 112. When diverter gate 34 is in its lower position, as best seen in FIG. 7, it actually forms a continuation of the upper chute 22 so that when gate 34 is in its "down" position, an incoming package from infeed conveyor 16 passes directly over gate 34 and thence down upper chute 22. However, when the diverter gate 34 is pivoted to its "up" position as illustrated in phantom in FIG. 7, the incoming packages from conveyor 16 move directly into the inlet end portion 28 of the lower chute 24 and thus travel therealong to the discharge end 32 thereof. In order to effect the pivoting movement of diverter gate 34, the outwardly projecting ends of rod 110 are rigidly affixed to respective downwardly extending arms 114, the lower ends of the arms being interconnected together by a further transversely extending rod 116, with one end of rod 116 being pivotally connected at point 118 to the ram of a pneumatically operated diverter gate actuator cylinder 120. The diverter cylinder 120 is pivotally connected via mounting bracket 122 mounted to the upper surface of the top plate 56. Thus, as the ram of diverter cylinder 120 is alternately retracted and extended, the diverter gate is correspondingly moved between its "down" and "up" positions as best illustrated in FIG. 7. By virtue of this action, incoming packages from infeed conveyor 16 are alternately diverted or directed into the infeed ends 26 and 28 of the upper and lower chutes 22 and 24 respectively. The particular diverter gate arrangement as shown is capable of separating incoming packages even if there is very little spacing between them. By virtue of the location of the pivot axis for the gate 34 at the extreme infeed end 26 of the upper chute 22, the diverter gate 34 can be started toward the "up" position when only two-thirds of the length of a first package is on the gate with the diverter gate being started toward the down position before a second bag is all the way into the inlet end 28 of the lower chute 24.

In order to sense the incoming packages from infeed conveyor 16, a light sensitive cell 126 is positioned above and somewhat forwardly of the entrance end to the chute and diverter assembly 20. This light sensitive cell 126 is mounted on a suitable bracket 128 above the path of travel of the incoming packages. A light source 130 is positioned below the path of travel of the incoming packages on a suitable mounting bracket 132. By properly positioning the cell 126 and the light source 130, the presence or absence of incoming packages is detected with the cell 126 emitting an output in response thereto which output is used to actuate the electronic control system in the manner to be hereinafter described.

Figure 5:
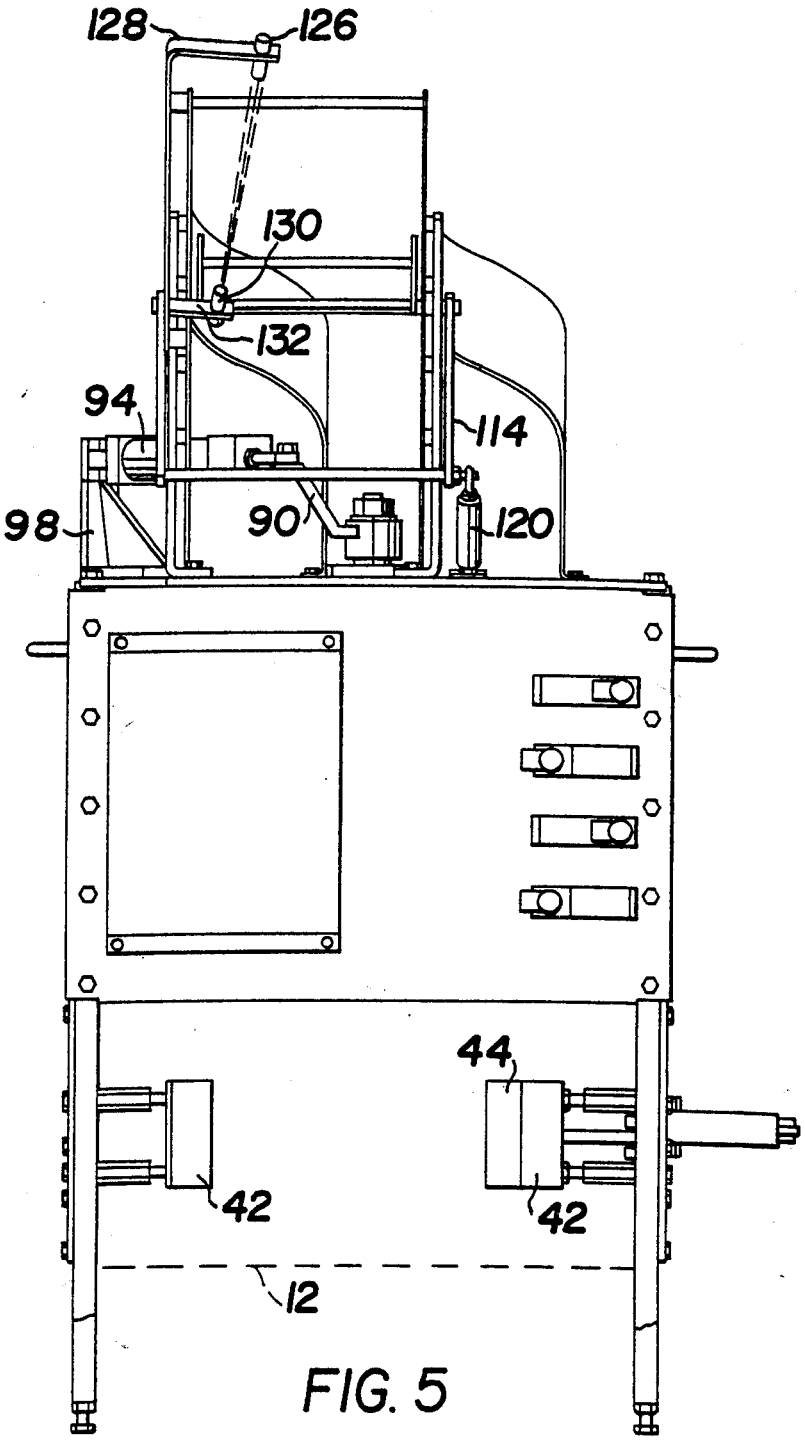
FIG. 5 is an end elevation view of the apparatus.

Reference was made previously to the guide means 42 for guiding empty shipping containers into the loading station beneath the loading head and to the stop hook 44 for positively locating a container beneath the loading head while the packages are being released thereinto. With further reference to FIGS. 3, 4 and 5, it will be seen that the guide means 42 comprise a pair of elongated plates which flank the path of travel of the cases as they are moved along by conveyor 12 toward the loading station. These guides are connected to the main frame 50 of the apparatus by means of adjustable mounting members 140, the latter permitting the guide members 42 to be laterally moved inwardly or outwardly toward one another thereby to accommodate for varying sizes of shipping containers.

In order to establish the loading position, as indicated in dashed lines in FIG. 4, of the shipping containers, the stop hook 44 is pivotally connected via arm 142 and pivot bracket 144 to the frame 50 of the apparatus. This stop hook 44 is moved to and fro in a horizontal plane by means of case release cylinder 146 the latter being pivotally mounted to the machine frame via a bracket 148. When the ram of cylinder 146 is extended, the stop hook 44 moves into the path of travel of the container such that it comes into contact with surface 44*a* of hook 44. It will also be noted that a microswitch 150 is positioned closely adjacent the stop hook 44, such microswitch having a switch arm 152 which is contacted by the shipping container when the latter reaches its loading position. If an empty container does not reach the loading position, the microswitch 150 will not be activated and the operation of the apparatus will be halted in the manner to be described hereinafter.

It will also be noted that the case guide member 42 which is located opposite the stop hook 44 is provided with a step or offset portion 154. It will also be seen that there is a further microswitch 156, which may be termed a container reset switch, located in the region of the offset portion 154. After a container at the loading position has been loaded with the flexible packages, the ram of cylinder 146 retracts thereby allowing conveyor 12 to move the container forwardly. Shortly after the trailing edge of the container comes alongside the recessed portion 154, the ram of cylinder 146 is advanced so that the hook 44 causes the loaded container to be moved laterally relatively to the conveyor and into the recessed portion 154 such that the container contacts the arm 158 of the reset switch 156. This indicates to the control system that the loaded container has been released from the loading position. In the event that the loaded container has not been properly released, and remains wholly or partially in the loading position, the container cannot be moved into the recessed portion 154 and the reset switch 148 will not be contacted as a result of which the infeed conveyor 16 will be disabled thus interrupting the operation of the apparatus.

The normal operating sequence of the apparatus is as follows:

(1) No. 1 package is moved inwardly toward the machine by infeed conveyor 16 and passes the light responsive cell 126 and the No. 1 package passes into the entrance of the top chute 22 for travel therealong into a respective one of the pockets 38 of load head 36. When the No. 1 package has passed the cell 126 the diverter gate 34 pivots upwardly and awaits the entry of the No. 2 package to the system.

(2) No. 2 package passes the cell 126 and passes along the lower chute 24 and into a respective one of the pockets of the load head 36. When the No. 2 package has passed the cell 126 the diverter gate 34 pivots downwardly and awaits the entry of the No. 3 package.

(3) The loading head 36 is then rotated 90° by virtue of the action of the previously described pneumatic cylinder 94 after a suitable time delay thereby to allow the No. 2 package to reach its pocket in load heat 36.

(4) No. 3 package passes photocell 126 and then passes along the upper chute 22. It should be noted here that steps No. 3 and 4 can occur simultaneously. Again, after the package has passed the cell 126 the diverter gate moves upwardly ready for package No. 4.

(5) The No. 4 package passes the cell 126 and the package travels along lower chute 24 into an associated one of the pockets of the load head 36. When the package has passed the photo eye 126, the diverter gate moves downwardly ready for the No. 1 package of the next load sequence. (6) All of the pneumatic cylinders 72 are actuated simultaneously after a time delay sufficient to allow the package to travel along lower chute 24 and into its pocket in load head 36 with pneumatic cylinders 72 serving to open the release gates 40 thereby allowing all four packages to drop simultaneously into an empty shipping container positioned at the loading station.

(7) The four discharge gates 40 are then closed in time to hold the No. 1 package of the next cycle in the loading head 36.

The loading cycle (steps 1 to 7) repeats.

(8) Simultaneously as the signal is sent to effect closure of the four discharge gates 40, the stop hook 44 is actuated so as to release the filled container thereby to allow the latter to move out from under the loading head 36.

(9) After a preselected time delay, the stop hook 44 moves back and in so doing, pushes the loaded container to one side and into the recessed portion 154 of the guide 42 with the stop hook 44 then being in a position to stop an incoming empty container at the loading position.

(10) When the loaded container is pushed to one side, it contacts the microswitch 156 which in turn indicates to the control system that the loaded container has been released from the loading position.

(11) The empty container coming into the loading position under the load head 36 makes the microswitch 150 and indicates to the control system that an empty container is in position for loading.

The cycle outlined above in steps 8–11 repeats for each completed cycle indicated by steps 1–7.

To summarize, it will be noted from the above that the diverter gate acts to alternately separate the packages as they are fed from the infeed conveyor 16 and to send the first package down upper chute 22, the second down chute 24, the third down chute 22 and the fourth down chute 24 and so on. The next basic operation is to rotate the load head 36 which receives packages from the two chutes 22 and 24 after the first two packages of each cycle have been received in the loading head. This rotation can be accomplished without interrupting the infeed flow of packages because the following package after the signal to rotate the load head is given must travel down the long chute 22. This gives sufficient time to rotate the load heat 36 even if the second and third packages are spaced close together on the infeed conveyor 16.

The next basic operation is to drop all of the packages simultaneously into the container positioned directly below the load head 36. This is done after four packages have been received in the load head. This simultaneous release is achieved by opening the four release gates 40 located at the bottoms of each of the pockets 38 of the load head. As noted above this is accomplished by the four pneumatic cylinders 72 which are connected to the respective release gates 40. The next basic operation is to release the filled container from the loading position beneath the load head and this is done by retracting the stop hook 44.

All of the above functions are performed without interruption of the package infeed to chutes 22 and 24. The step of unloading the load head 36 is done while the first package of the next cycle is travelling down the relatively long chute 22. Thus, both load head rotation and load head unloading are accomplished while a package is travelling down the long chute 22.

As was noted previously, the diverter gate 34 is capable of separating packages entering from infeed conveyor 16 even if there is very little spacing between them. By virtue of the diverter gate arrangement and the manner in which it is pivoted, the diverter can be started toward the up position when only two-thirds of the first package is positioned thereon and start down before the second package is all the way into the lower chute 24.

The use of the two chutes 22 and 24 plays a part in the system timing and allows for rotation of the loading head 36 and unloading of the load head 36 without interrupting the infeed of the packages. It was noted previously that chute 22 is somewhat longer and at a somewhat shallower angle than chute 24. The second package of a cycle always goes down chute 24 as does the fourth package. The second package always triggers the rotation of load head 36 and the fourth package of a cycle always triggers the unloading of the load head. There is sufficient time to perform these functions since chute 22 is of such a slope and such length as to provide a sufficient length of travel time for the third and fifth packages etc., as to perform these functions.

Furthermore, by using a loading head 36 rather than simply dropping the packages directly into the case, one is able to pack the packages much tighter into the shipping container since no dividers are necessary to maintain orientation so long as all four packages are dropped at the same time. The 90° rotation of the load head allows one to bring the remaining two empty pockets in under the discharge ends of the chutes 22 and 24 after the first two packages of each cycle have been positioned in the pockets. The 90° rotation occurs only once in each full cycle. Thus, in the first loading cycle one would move, say, clockwise, and in the next cycle counterclockwise and so on. This makes the mechanics of the rotating action of the load head relatively simple i.e., the simple pneumatic cylinder and lever arm arrangement described above.

The previously referred to control and actuator system includes the above described pneumatic cylinders together with electrically actuated solenoid valves and an electrical control circuit which will be briefly described hereinafter. It will be realized by those skilled in the art that this invention is not limited to use with any one form of control system but that other control systems can be devised by those skilled in the art having regard to applicant's apparatus and the sequence of operation of same.

Figure 10:
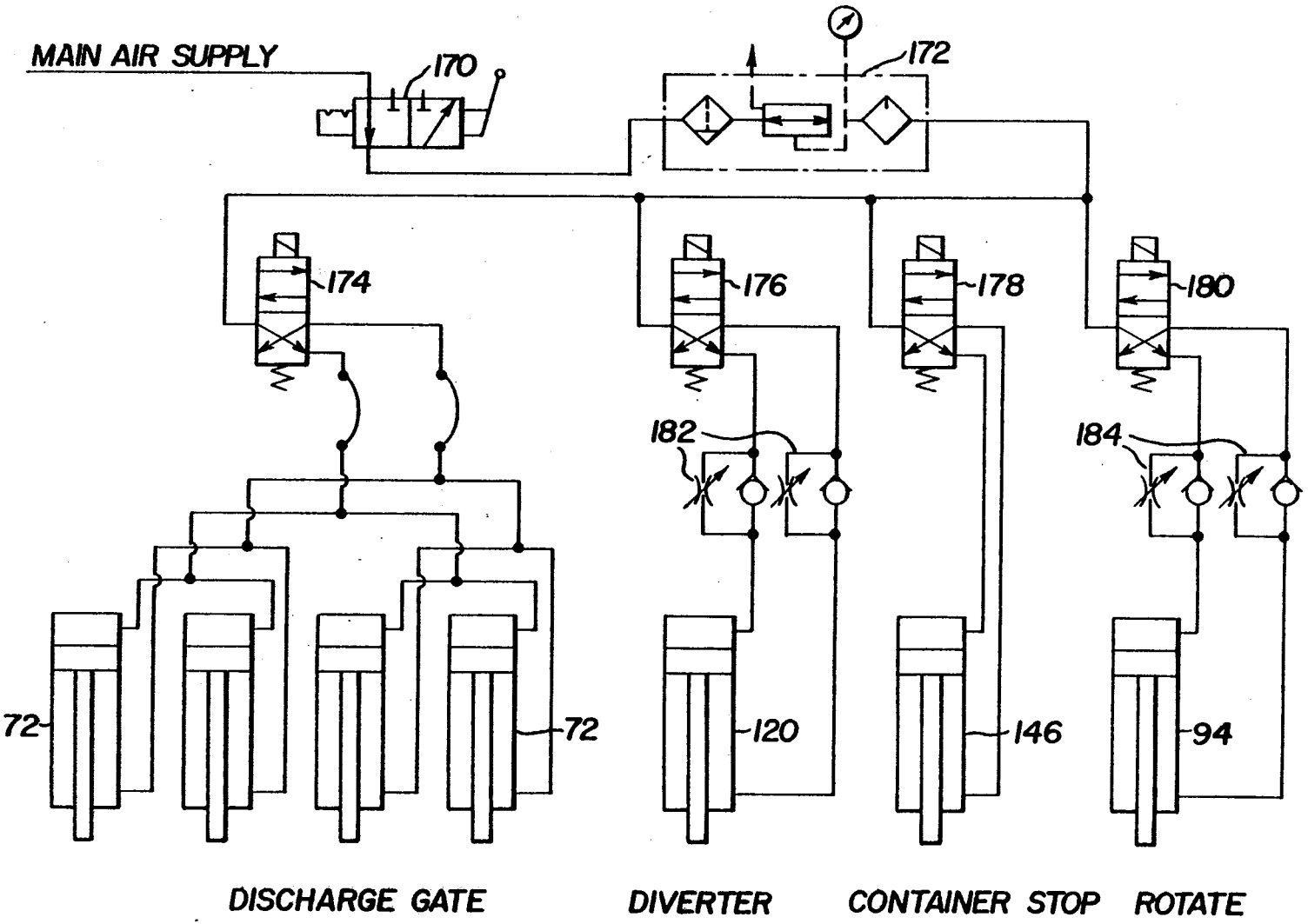
FIG. 10 is a schematic layout of the pneumatic actuator system.

The pneumatic control circuitry is illustrated schematically in FIG. 10. It will be seen that air from a main air supply passes through a manually controlled shut-off valve 170 and thence passes through an air filtering and air pressure regulating assembly 172. The air is then distributed to a series of electrically actuated solenoid valves 174, 176, 178 and 180. Solenoid valve 174 serves to actuate the four discharge gate pneumatic cylinders 72. It will be seen that all of these cylinders are linked together such that they are all actuated simultaneously by solenoid valve 174. Solenoid valve 176 serves to actuate the diverter gate cylinder 120. It will be noted that the air supply and return lines between solenoid valve 176 and cylinder 120 are provided with air flow regulator means 182 thereby to enable the rate of movement of the diverter gate 34 to be adjusted as desired. Similar air flow regulator means 184 are provided between solenoid valve 180 and the load heat rotate cylinder 94. Solenoid valve 178 serves to control the air supply to the case stop hook cylinder 146.

Figure 9:
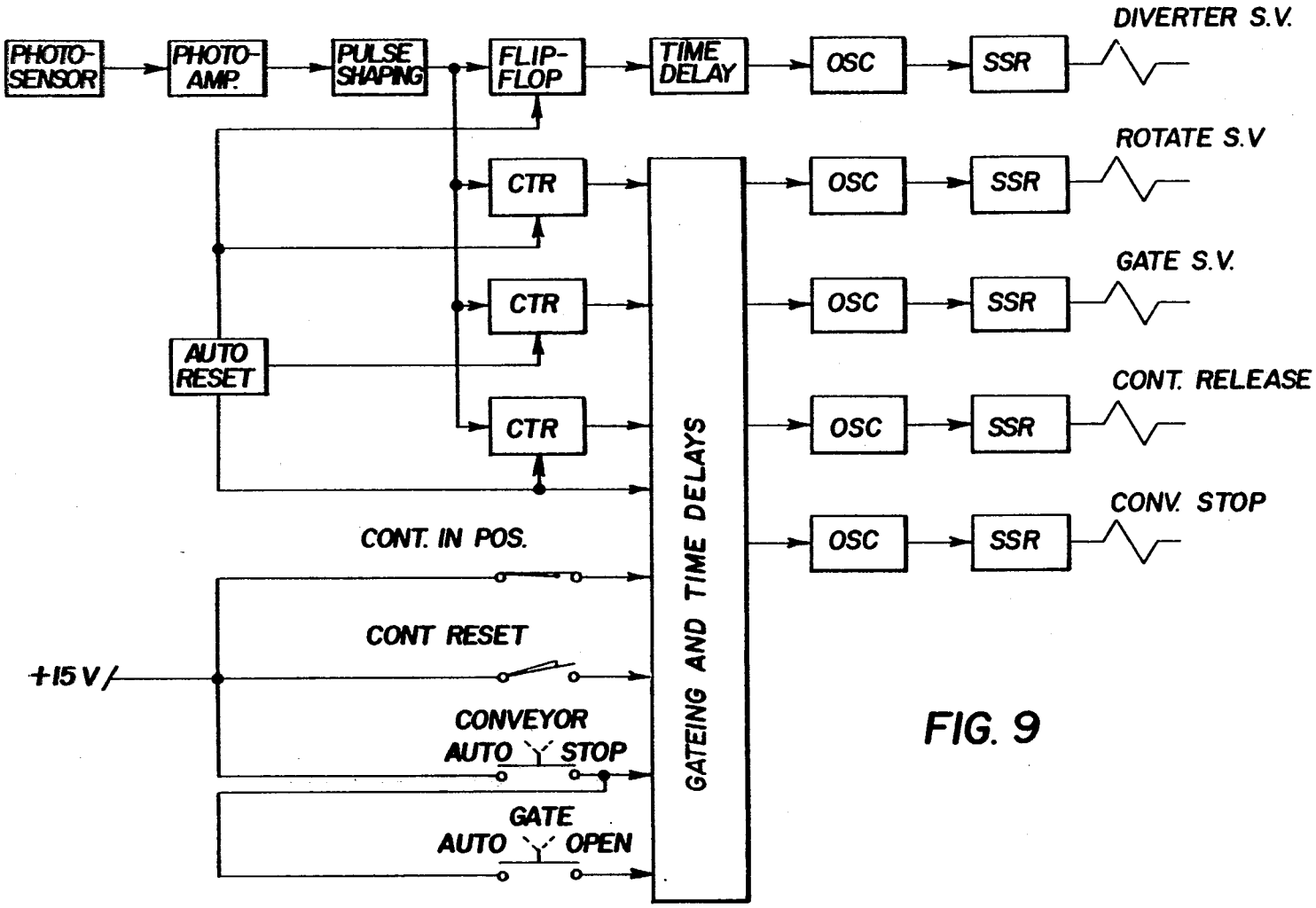
FIG. 9 is a schematic layout of the electrical control circuitry for the apparatus.
Figure 11A:
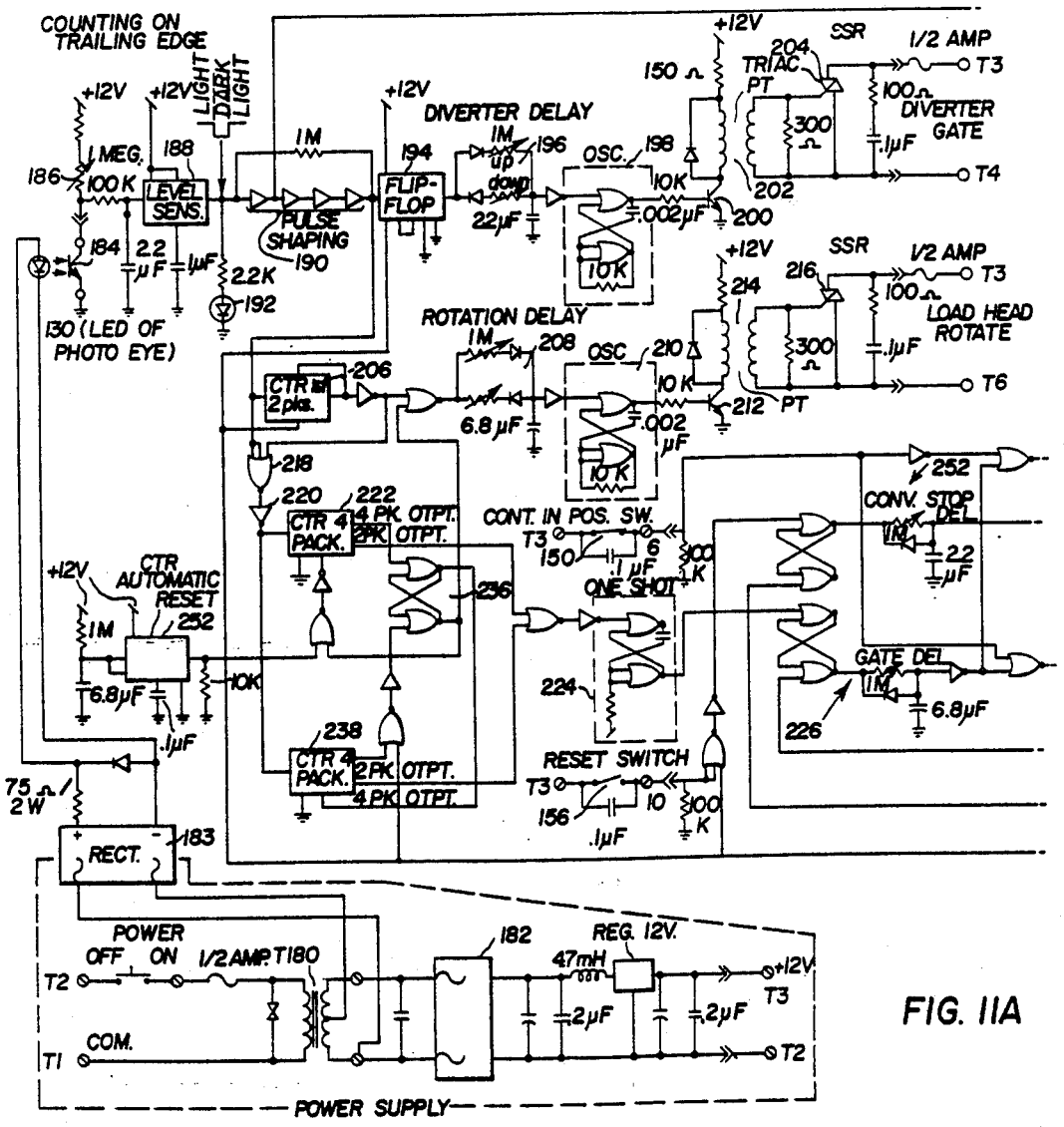
FIGS. 11A, 11B is a detailed layout of the electrical control circuitry.
Figure 11B:
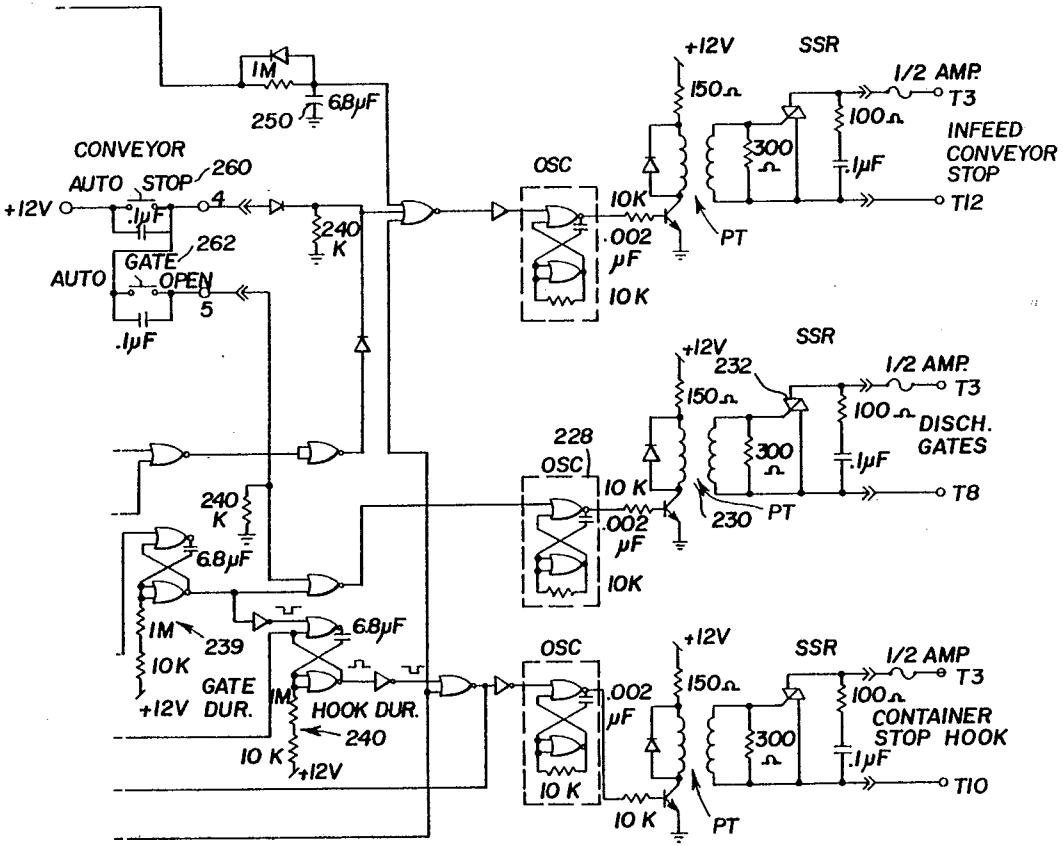

The electrical control circuitry for actuating the various components of the apparatus is illustrated diagrammatically in FIG. 9 and is shown in detail in FIG. 11A, 11B. The electrical control circuit shown in FIG. 11A, 11B is of the solid state variety and is conveniently located on a circuit card which is mounted in a control box attached to the side of the machine frame.

Turning now to FIG. 11A, 11B, the electrical control system includes a regulated power supply which is connected at terminals T1 and T2 to a 110 volt AC supply input. From here the voltage is dropped to 12 volts through a transformer T180 and then passes through rectifier 182 to provide a 12 volt DC output. This 12 volt DC output is then used to operate the control circuit. The previously mentioned light source 130 comprises a photoeye LED (light emitting diode) which is supplied with 0.7 volts DC current from rectifier 183.

The photoeye LED output is picked up by a phototransistor 184 which forms an essential part of the above-noted light sensitive cell 126. This unit is provided with a sensitivity adjustment by way of the variable resistance 186. The phototransistor signal is picked up by the level sensor chip 188 whose output goes through a pulse shaping circuit 190. A second output from the level sensor chip signals LED 192 which is located on the control circuit card and which serves as an indicator to maintenance personnel for trouble-shooting the photoeye system.

The diverter gate control system includes flip-flop 194 which receives a signal from the pulse shaping circuit 190. The signal from the flip-flop passes through the time delay adjustment circuitry 196 which includes two variable resistors which can be adjusted to control the amount of delay action in the diverter in both the "up" and "down" directions. From there, the signal passes into a 5 Kz oscillator circuit 198. The output of oscillator ciruit 198 triggers the transistor 200 which, in turn, sends a signal through the pulse transformer PT 202 which output pulse, in turn, serves to activate the triac 204. The triac 204, acting as a switch, then activates the coil of the solenoid valve 176 to trigger the diverter gate up. The above described solid state relay circuit is designated by the letters SSR. The second signal caused by the passage of a second package past the photoeye system signals the diverter gate to return down.

The control circuit employs a counting system which will now be described. The system incorporates a four count system because each load cycle dumps four packages. However, each time the power is switched on, the load head 36 must rotate after the first two packages enter the feed chutes 22 and 24.

The load head rotate circuitry employs chip 206 as a counter for the first two packages on start-up. Counter chip 206 receives its signal from the output of flip-flop 194. After having counted the passage of the first two packages, this chip 206 then signals the load head rotate action through an adjustable time delay circuit 208, oscillator circuit 210, transistor 212, pulse transformer PT 214, and triac 216 similar to the arrangement described for the diverter gate system.

The above noted counter 206 then signals the NOR gate 218 to open sending a signal through an inverter 220 and into a second counter 222 which has two outputs. The first output occurs after the counter receives two input signals while the second output occurs after the counter has received four input signals.

The discharge gate control system functions as follows. The first output signal of counter 222 is sent to the gate control solenoid 174 via the one-shot circuit 224, the variable gate delay circuit 226, oscillator circuit 228, pulse transformer PT 230, and the triac 232. The second signal resulting from four input signals to counter 222 goes through the flip-flop 236 which activates a further counter 238 as well as sending a signal to the load head rotate control circuitry. Counter 238 has a twin output identical to the output of counter 222. The first output triggers the discharge gate control circuitry through the gate delay circuitry etc., with the second output returning through the flip-flop 236 thus restarting counter 222 and signalling the load head rotate circuitry described above.

The container stop hook 44 is activated in the following manner. The signal going to the gate control circuitry from counter 238 is also sent to the stop hook solenoid 178 after the gate duration time delay circuitry 239 has timed out i.e. the hook 44 is actuated to release the filled container at the same time as the discharge gates 40 are told to close. The hook duration circuit 240 determines how long the container stop hook 44 remains in the retracted position.

The previously described microswitch 150 (normally closed) is interconnected to the gate open signal and serves to indicate that a container is in the loading position beneath the load head. If microswitch 150 is not opened, the NOR gates will stop the infeed conveyor 16 immediately after the gate delay 226 has timed out. Once the container is put in the loading position thereby to open microswitch 150, the discharge gates 40 will open immediately while at the same time power is restored to the infeed conveyor as well.

The conveyor stop circuitry is also activated by way of an output from the pulse shaping circuit 190 in the event that the photoeye is blocked and hence remains in the dark mode longer than a pre-set time delay, as determined by the capacitor 250. This pre-set time delay is ordinarily in the order of 3 seconds.

The re-set system includes the above described microswitch 156 (normally open) which indicates that a filled container has left the loading position. This normally open switch must receive a signal to close from the container otherwise the conveyor stop circuitry will be activated through the conveyor stop time delay circuit 252.

The control system is also provided with an automatic system re-set for re-setting the counters after the power is shut off. The counters are re-set by way of re-set circuit chip 252.

Manual operation of the system is provided for by means of the manual conveyor stop and manual gate open switches 260 and 262. These switches are connected together so that the discharge gates may be triggered only if the conveyor is in the manual stop position. This serves to prevent package infeed while the discharge gates are being manually operated.

The photoeye sensitivity adjustment resistor 186, and the variable resistors associated with the diverter gate delay circuit 196, the load head rotation delay circuit 208, the infeed conveyor stop delay circuit 252, the discharge gate delay circuit 226, and the discharge gate and stop hook duration circuits 239 and 240 respectively, are all manually adjustable via control knobs (not shown) conveniently positioned on the control panel whereby the operation of the control circuit as a whole can be varied by operating personnel thereby to achieve the desired result.

Figure 12:
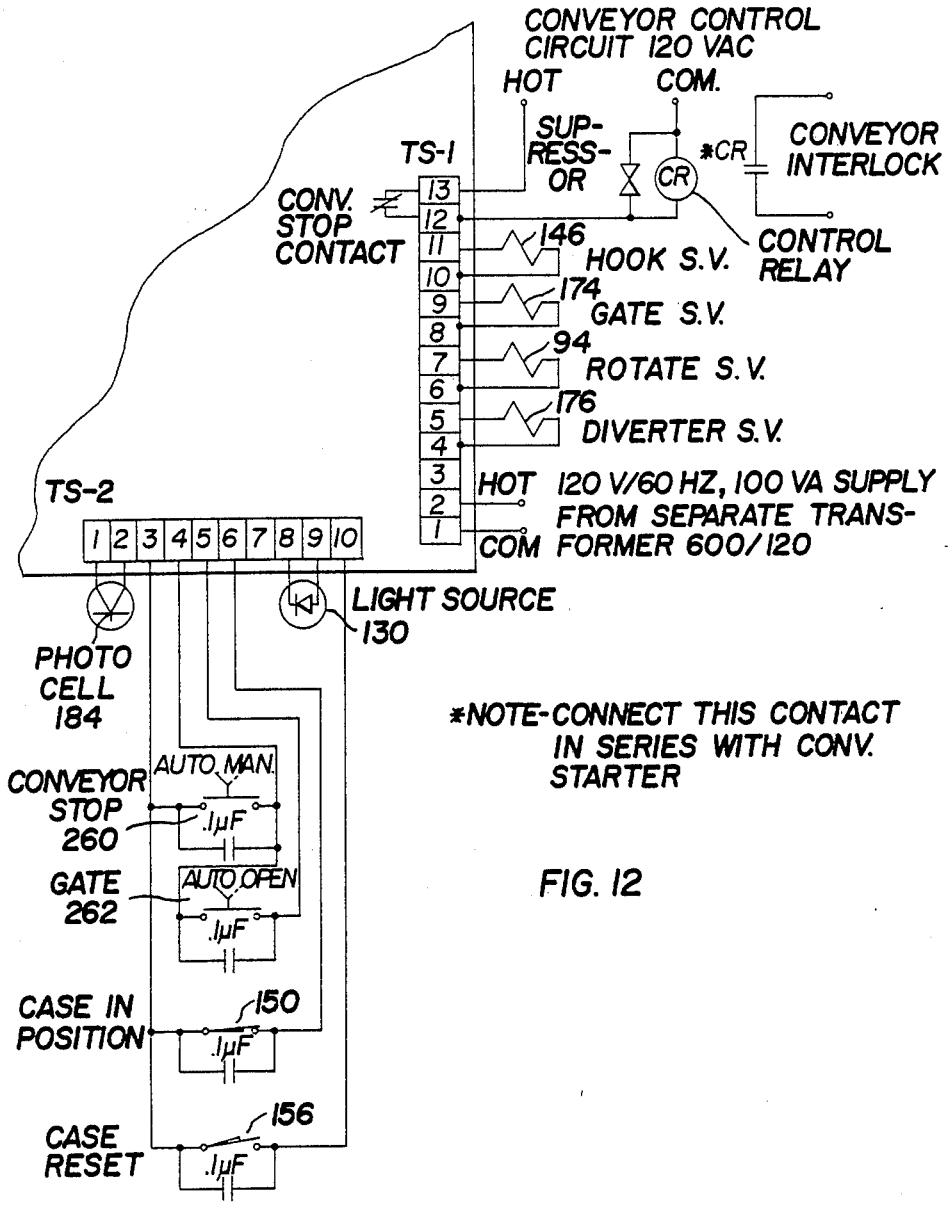
FIG. 12 is a further layout of portions of the electrical control circuitry illustrating the connections to the several terminal strips.

FIG. 12 illustrates the manner in which the various solenoid valves are electrically connected to the terminal strip TS-1. Also illustrated is the manner in which electrical power is supplied to the terminal strip. The conveyor control circuit and the conveyor interlock circuit are also illustrated diagrammatically. The second terminal strip TS-2 has connected thereto the light source and the photocell as well as microswitches 150 and 156 and the manual control gates 260 and 262. A further more detailed explanation of the electrical circuit is not considered to be necessary as the components are all of a standard nature and the manner of operation of same will be readily apparent to those skilled in the art.

It will be understood that this invention is not limited to the specific details of construction and arrangement thereof herein illustrated and that changes and modifications may occur to one skilled in the art without departing from the spirit or scope of the invention as hereinafter claimed.

We claim:

1. Apparatus for placing flexible packages in a rigid container comprising:

(a) means defining a plurality of chutes, each having an infeed end and a discharge end, the chutes being adapted for travel of packages therethrough from the infeed end to the discharge end, (b) a diverter gate located at the infeed end of the chutes for selectively directing packages moving toward the infeed ends of the chutes into the infeed ends of the respective chutes, (c) a loading head associated with the discharge ends of the chutes, the loading head having a plurality of pockets therein each adapted to hold a package received therein from the discharge ends of the chutes, (d) the loading head being rotatably mounted to enable selected pockets thereof to be each positioned to receive a package from a respective one of the discharge ends of the chutes, (e) discharge gates respectively associated with the pockets of the loading head for releasing packages therein and dropping them into a rigid container which, during operation, has been moved into a position below the loading head;

(f) and control and actuator means for actuating the diverter gate, rotating the loading head and actuating the discharge gates in predetermined cyclic fashion to enable continuous packaging of the packages in successive rigid containers which have been individually positioned below the loading head.

2. Apparatus according to claim 1 wherein said plurality of chutes comprises first and second chutes, said loading head having first and second pairs of said pockets therein and arranged such that when the loading head is in a first position, the pockets of the first pair are each aligned with a respective one of the discharge ends of the first and second chutes, and when the loading head is in a second position the pockets of the second pair are each aligned with a respective one of said discharge ends.

3. Apparatus according to claim 2 wherein the loading head is mounted for rotation about a vertical axis and wherein the pockets therein are disposed in side-by-side generally vertical orientation about said rotation axis.

4. Apparatus according to claim 2 wherein said control and actuator system is adapted to respond to the passage of packages toward the infeed ends of the said chutes and to (a) move the diverter gate so as to direct individual incoming packages alternately down the first and second chutes, (b) to rotate the loading head from the first position to the second position after a package is located in each of the pockets of the first pair, and (c) actuate the discharge gates after a package has been positioned in each of the pockets of the first and second pairs to release the packages from the loading head.

5. Apparatus according to claim 4 wherein the first chute is arranged such that a package travelling therealong takes a longer time to travel from the infeed end to the discharge end than does a package travelling along the second chute, thereby to allow sufficient time to release the packages from the loading head while a further package is travelling along the first chute.

6. Apparatus according to claim 4 wherein the first and second positions of the loading head are about 90° apart.

7. Apparatus according to claim 1 including stop means for positively locating the rigid container at a loading station defined beneath the loading head while packages are being released thereinto, the control and actuator means further being adapted to actuate the stop means to allow a filled container to be moved away from the loading station and an empty container to take its place while the pockets of the loading head are receiving packages from the discharge ends of the chutes.

8. Apparatus according to claim 4 including stop means for positively locating the rigid container at a loading station defined beneath the loading head while packages are being released thereinto, the control and actuator means further being adapted to actuate the stop means to allow a filled container to be moved away from the loading station and an empty container to take its place while the pockets of the loading head are receiving packages from the discharge ends of the chute.

9. Apparatus according to claim 6 wherein the loading head is mounted for rotation about a vertical axis and wherein the pockets therein are disposed in side-by-side generally vertical orientation about said rotation axis, the pockets of the loading head being generally rectangular in plan, the pockets of each pair being spaced apart in the direction of their width dimensions and being overlapped with one another in the direction of their length dimensions.

10. Apparatus according to claim 7 wherein the control and actuator means includes means for sensing the presence of a container at the loading station for receiving packages from the loading head, and means for stopping the feed of packages to the infeed ends of the chutes in the absence of a container at the loading station.

11. Apparatus according to claim 7, which apparatus is adapted to be used in conjunction with a conveyor line defining a path of travel for the rigid containers with the loading head located over the path of travel so that the conveyor line is capable of supplying empty containers to the loading station and moving filled containers away therefrom.

12. Apparatus according to claim 1 wherein said discharge gates are each located at the bottom of their associated pockets, the pockets being arranged to receive and to hold the packages in closely spaced upright orientation, the control and actuator means being adapted to open the gates simultaneously, with the gates and pockets being arranged to induce the released packages to maintain their orientation as they fall into the container.

13. Apparatus according to claim 9 wherein the discharge ends of the chutes overlap with one another to correspond with said overlap of the pockets of the load head.

14. Apparatus according to claim 1 wherein said chutes are adapted for movement of the packages therethrough under the influence of gravity.

15. Apparatus according to claim 1 wherein the control and actuator means includes means for sensing the passage of packages toward the infeed ends of the chutes and is adapted to respond to the passage of individual packages to effect the actuation of the diverter gate, loading head and discharge gates in said predetermined cyclic fashion.

16. Apparatus according to claim 2 wherein said diverter gate is pivotally mounted for movement about a horizontal axis between upper and lower positions, for directing the packages alternately into the infeed ends of the first and second chutes.

17. A method of packaging flexible package in a rigid container comprising:

(a) feeding the packages along a conveyor line in single file, (b) separating the packages and directing single packages alternately into respective ones of a plurality of chutes;

(c) allowing each of the packages to travel individually along the chutes and causing each package to pass into a respective one of a plurality of vertically disposed pockets of a rotatable load head, and, after the last one of a first group of the packages has been located in a respective pocket of the load head, (d) rotating the load head to position a further plurality of pockets thereof in locations each to accept a respective one of the packages of a second group from the chutes and, after the last one of the second group of packages is in a respective one of the further plurality of pockets, (e) releasing all four packages simultaneously from the pockets of the load heads such that they fall by gravity into a rigid container positioned below the load head, (f) the pockets of the loading head being arranged to hold the packages in preselected upright orientation relative to one another, with the release of the packages being effected such that the preselected orientation of the packages is substantially retained as they drop into the rigid container, the container being shaped and dimensioned to snugly receive the packages and to maintain the orientation thereof;

(g) moving the filled container away from beneath the load head and moving an empty container into position below the load head, (h) and continuing to carry out the above recited steps to effect packaging of groups of packages in successive rigid containers.

18. The method of claim 17 wherein the packages are released as a first package of a further group is travelling along one of the chutes toward the load head with the time of travel along said one of the chutes occupying a sufficient internal of time as to permit the releasing step to be completed before the first package of the further group enters the load head.

19. The method of claim 18 wherein the filled container is moved away from beneath the load head and an empty container is moved into loading position while the pockets of the load head are being filled with a further group of flexible packages.

20. The method of claim 17 wherein the packages are held by the pockets of the loading head in a closely juxtaposed generally rectangular-in-outline array to enable them to fit snugly into a rigid container of corresponding rectangular outline shape.

21. A method of packaging flexible packages in a rigid container comprising:

(a) feeding the packages along a conveyor line in single file with the packages lying on their sides, (b) separating the packages and directing single packages alternately into first and second chutes;

(c) allowing the packages to travel along the first and second chutes and thence into vertically disposed first and second pockets of a rotatable load head, and, after a second one of the packages has been located in the second pocket of the load head, (d) rotating the load head to position third and fourth pockets thereof in locations to accept third and fourth packages from the first and second chutes, after the third and fourth packages are in the third and fourth pockets, (e) releasing all four packages simultaneously from the pockets of the load heads such that they fall by gravity into a rigid container positioned below the load head while a further package is travelling along the first chute, (f) the pockets of the loading head being arranged to hold the packages in upright generally rectangular-in-outline array in close juxtaposition to one another, with the release of the packages being effected such that the orientation of the packages is retained as they drop into the rigid container, the container being of a corresponding rectangular shape such that the packages fit snugly therein, (g) moving the filled container away from beneath the load head and moving an empty container into position below the load head, while the load head pockets are being filled with a further group of flexible packages, (h) and carrying out the above recited steps (a), (b) and (c) in continuous fashion and repeating the remaining steps in cyclic fashion to effect continuous packaging of the packages in successive rigid containers.

22. Apparatus for placing flexible packages in a rigid container comprising:

(a) means defining a plurality of chutes, each having an infeed end and a discharge end, the chutes being adapted for travel of packages therethrough from the infeed end to the discharge end, (b) a diverter means for selectively directing packages into the infeed ends of the respective chutes, (c) a loading head associated with the discharge ends of the chutes, the loading head having a plurality of pockets therein each adapted to hold a package received therein from the discharge ends of the chutes, (d) the loading head being movably mounted to enable selected pockets thereof to be each positioned to receive a package from a respective one of the discharge ends of the chutes, (e) discharge means respectively associated with the pockets of the loading head for releasing packages therein and dropping them into a rigid container which, during operation, has been moved into a position below the loading head;

(f) and control and actuator means for actuating the diverter means, moving the loading head and actuating the discharge means in predetermined cyclic fashion to enable continuous packaging of the packages in successive rigid containers which have been individually positioned below the loading head.

23. Apparatus according to claim 22 wherein said discharge means are each located at the bottom of their associated pockets, the pockets being arranged to receive and to hold the packages in closely spaced upright orientation, the control and actuator means being adapted to open the discharge means, with the discharge means and pockets being arranged to induce the released packages to maintain their orientation as they fall into the container.

24. Apparatus according to claim 23 wherein the control and actuator means includes means for sensing the passage of packages toward the infeed ends of the chutes and is adapted to respond to the passage of individual packages to effect the actuation of the diverter means, loading head and discharge means in said predetermined cyclic fashion.

25. Apparatus according to claim 22 wherein said diverter means comprises a gate pivotally mounted for movement about a horizontal axis between upper and lower positions, for directing the packages alternately into the infeed ends of the first and second chutes.

26. Apparatus according to claim 22 wherein said plurality of chutes comprises first and second chutes, said loading head having first and second pairs of said pockets therein and arranged such that when the loading head is in a first position, the pockets of the first pair are each aligned with a respective one of the discharge ends of the first and second chutes, and when the loading head is in a second position the pockets of the second pair are each aligned with a respective one of said discharge ends.

27. Apparatus according to claim 26 wherein the loading head is mounted for rotation about a vertical axis and wherein the pockets therein are disposed in side-by-side generally vertical orientation about said rotation axis.

28. Apparatus according to claim 27, wherein said control and actuator system is adapted to respond to the passage of packages toward the infeed ends of the said chutes and to (a) move the diverter means so as to direct individual incoming packages alternately down the first and second chutes, (b) to rotate the loading head from the first position to the second position after a package is located in each of the pockets of the first pair, and (c) actuate the discharge means after a package has been positioned in each of the pockets of the first and second pairs to release the packages from the loading head.

29. Apparatus according to claim 28 wherein the first chute is arranged such that a package travelling therealong takes a longer time to travel from the infeed end to the discharge end than does a package travelling along the second chute, thereby to allow sufficient time to release the packages from the loading head while a further package is travelling along the first chute.

30. Apparatus according to claim 29 wherein the first and second positions of the loading head are about 90° apart.

31. Apparatus according to claim 29 including stop means for positively locating the rigid container at a loading station defined beneath the loading head while packages are being released thereinto, the control and actuator means further being adapted to actuate the stop means to allow a filled container to be moved away from the loading station and an empty container to take its place while the pockets of the loading head are receiving packages from the discharge ends of the chutes.

32. Apparatus according to claim 31 wherein the control and actuator means includes means for sensing the presence of a container at the loading station for receiving packages from the loading head, and means for stopping the feed of packages to the infeed ends of the chutes in the absence of a container at the loading station.

33. Apparatus according to claim 32, which apparatus is adapted to be used in conjunction with a conveyor line defining a path of travel for the rigid containers with the loading head located over the path of travel so that the conveyor line is capable of supplying empty containers to the loading station and moving filled containers away therefrom.

* * * * *